United States Patent [19]

Marsh

[11] 4,393,797

[45] Jul. 19, 1983

[54] ARRANGEMENT AND METHOD FOR PREVENTING FALSE TRIGGERING IN AN OPTICALLY SWITCHED BUTTONHOLE MECHANISM

[75] Inventor: Walter H. W. Marsh, Scotch Plains, N.J.

[73] Assignee: The Singer Company, Stamford, Conn.

[21] Appl. No.: 449,093

[22] Filed: Dec. 13, 1982

[51] Int. Cl.[3] ..... D05B 3/06

[52] U.S. Cl. ..... 112/158 B; 112/264.1

[58] Field of Search ..... 112/158 B, 158 E, 77, 112/264.1, 235, 65

[56] References Cited

U.S. PATENT DOCUMENTS

| | | | |
|---|---|---|---|
| 4,182,249 | 1/1980 | Matumura et al. | 112/158 B |
| 4,216,732 | 8/1980 | Marsh et al. | 112/158 B |
| 4,232,617 | 11/1980 | Garron | 112/158 B |
| 4,363,281 | 12/1982 | Reinke | 112/121.11 |

*Primary Examiner*—Peter P. Nerbun

*Attorney, Agent, or Firm*—David L. Davis; Robert E. Smith; Edward L. Bell

[57] ABSTRACT

An optical switching system for one step buttonholing substantially eliminates false triggering when an operator inadvertently moves an object within the viewing path of the optical sensor by utilizing signals from the sensors only when the sewing machine is running.

2 Claims, 2 Drawing Figures

ARRANGEMENT AND METHOD FOR PREVENTING FALSE TRIGGERING IN AN OPTICALLY SWITCHED BUTTONHOLE MECHANISM

DESCRIPTION

BACKGROUND OF THE INVENTION

This invention relates to sewing machines and, more particularly, to electronically controlled sewing machines including an optically switch buttonhole mechanism.

U.S. Pat. No. 4,216,732 discloses a sewing machine having an optical buttonhole switching arrangement in which the movements of reflective areas carried on a movable buttonhole foot are sensed as the foot is moved by the fabric feeding movement of a feed dog against the garment being sewn. The foot includes adjustable optical targets whose movements are sensed by photosensors carried on the sewing head. The spacing of the optical targets may be manually adjusted to accommodate buttons of different sizes. The photosensors are connected to an electronic circuit whose output is used to control the retrieval of buttonhole stitching information from an electronic memory. While such an arrangement performs generally satisfactorily, it has been found that false triggering of the sensors by the operator when the sewing machine is stopped occasionally occurs. This false triggering occurs primarily after the machine comes to a stop and the operator inadvertently places a hand, fabric, scissors or the like, under the sewing head within the field of view of the photosensors.

It is therefore an object of the present invention to provide a method and arrangement to prevent such false triggering.

SUMMARY OF THE INVENTION

The foregoing and additional objects are attained in accordance with the principles of this invention by providing such an arrangement in an electronically controlled sewing machine having a controller, a controllable drive motor, and an optical buttonhole mechanism including photosensitive means responsive to changes in the amount of light impinging thereon for providing buttonhole signals adapted to be used by the controller for sequencing through states in the formation of a buttonhole pattern. The arrangement operates in accordance with the inventive method and includes means enabled only during operation of the drive motor for transmitting the buttonhole signals to the controller.

BRIEF DESCRIPTION OF THE DRAWINGS

The foregoing will be more readily apparent upon reading the following description in conjunction with the drawings in which like elements in different figures thereof have the same reference character applied thereto and wherein.

DETAILED DESCRIPTION

Figure 1:
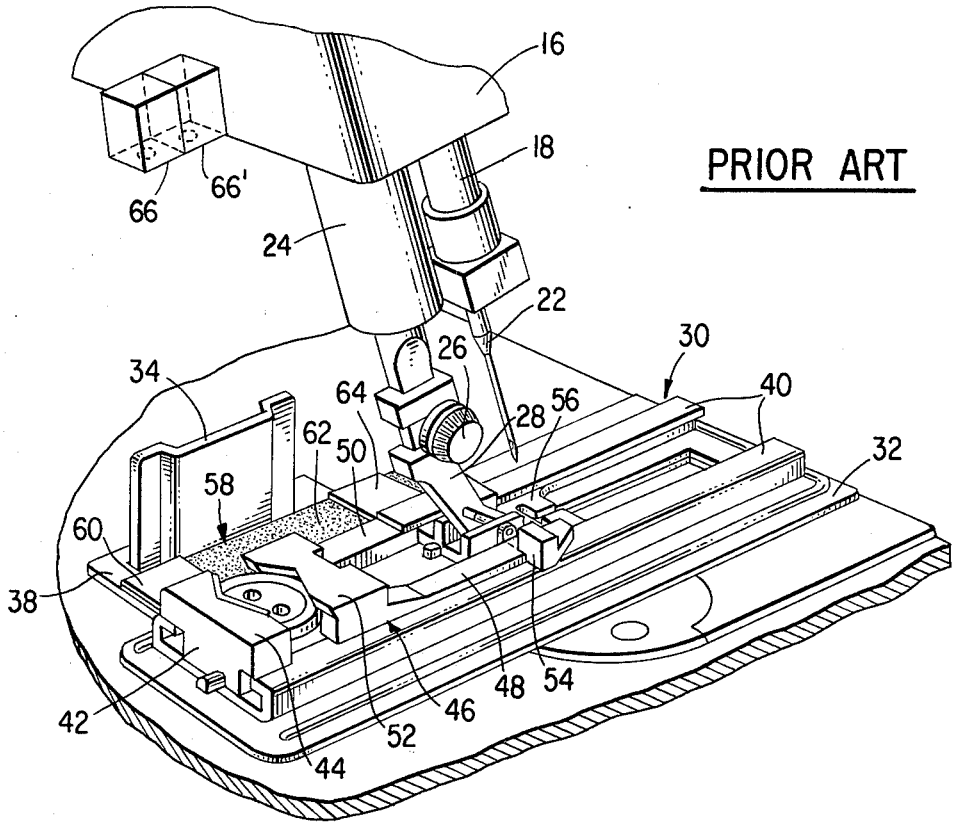
FIG. 1 is a perspective view of an optically switched buttonhole mechanism with which this invention is adapted for use.

Referring now to the drawings, FIG. 1 shows an optically switched buttonhole mechanism of the type disclosed in U.S. Pat. No. 4,216,732, which issued on Aug. 12, 1980, to Marsh et al, the teachings of which are incorporated herein by reference. Accordingly, FIG. 1 corresponds to FIG. 2 of the referenced patent and retains the same reference characters as the referenced patent. Thus, as is set forth in the referenced patent, journalled in the sewing head 16 of the sewing machine and adapted for endwise reciprocatory motion toward and away from the stitch forming area, is a needle bar 18 which has a clamp screw (not shown) to fasten thereto a sewing needle 22. Also journalled in the sewing head 16 is a presser bar 24 which has a clamp screw 26 for retaining thereto the shank portion 28 of a buttonhole foot which is shown generally at 30.

The buttonhole foot 30 includes a work engaging plate 32 which has an upstanding side wall 34 at the rearward extremity thereof. The upstanding wall 34 receives plate 38 which has fastened thereto a pair of spaced parallel tracks 40 which extend longitudinally in the direction of material feed on either side of an area penetrated by the endwise reciprocation of the needle 22. Fastened to the rearward extremity of the plate 38 between the tracks 40 is an anchor element 42 which includes an upwardly extending abutment 44 which has a "V" shaped notch formed therein.

The spaced parallel tracks 40 constrain a slidable button gauging element 46 and permit linear motion of the element 46 therealong. The button gauging element 46 is formed with spaced parallel guide rails 48 and 50 which are each shaped to overly one of the tracks 40 and which also have an inturned lip (not shown) to retain the button gauging element 46 to the tracks 40. The button gauging element 46 may be shifted toward and away from the anchor element 42 along the length of the track 40. The button gauging element 46 includes an upstanding portion 52 having a "V" shaped notch complemental to the notch carried in the abutment 44. The guide rail 48 includes an actuating tab 54 which may be grasped by an operator to slide the button gauging element 46 along the spaced parallel tracks 40. The foot 30 includes a slidable foot element 56 to which the shank 28 is pivotally fastened, and which is slidably mounted between the tracks 40 to permit movement of the buttonhole foot 30 along the line of material feed.

The optical buttonhole switching mechanism includes a fixed optical target 58 which is fastened to the plate 38 parallel to the tracks 40 and preferably is adjacent to the upstanding wall 34 of the work engaging plate 32. The fixed optical target 58 preferably includes a reflective portion 60 at the rearward extremity thereof, and a portion 62 having a low coefficient of reflectivity. Preferably the guide rail 50 of the button gauging element 46 has fastened thereto a movable optical target 64 which has a high coefficient of reflectivity similar to the reflectivity exhibited by the reflective portion 60 and which overlies the portion 62 of the optical target 58. The movable target 64 may be moved along the length of the fixed optical target 58 relative to the reflective extremity 60 by operator controlled movement of the button gauging element 46 through the use of the actuating tab 54.

The sewing head 16 has fastened thereto an optical sensor means, which is preferably shown as a pair of photosensors 66 and 66'. The sensors 66 and 66' are positioned so that they receive light which is reflected from the fixed optical target 58 or the movable optical target 64 as the buttonhole foot 30 is moved thereunder by motion of the feed dog (not shown) in the direction of material feed. The sensors 66 and 66' are spaced apart from each other along the line of fabric feeding so that they are sequentially exposed to light reflected from either the reflective portion 60 or the movable target 64.

Figure 2:
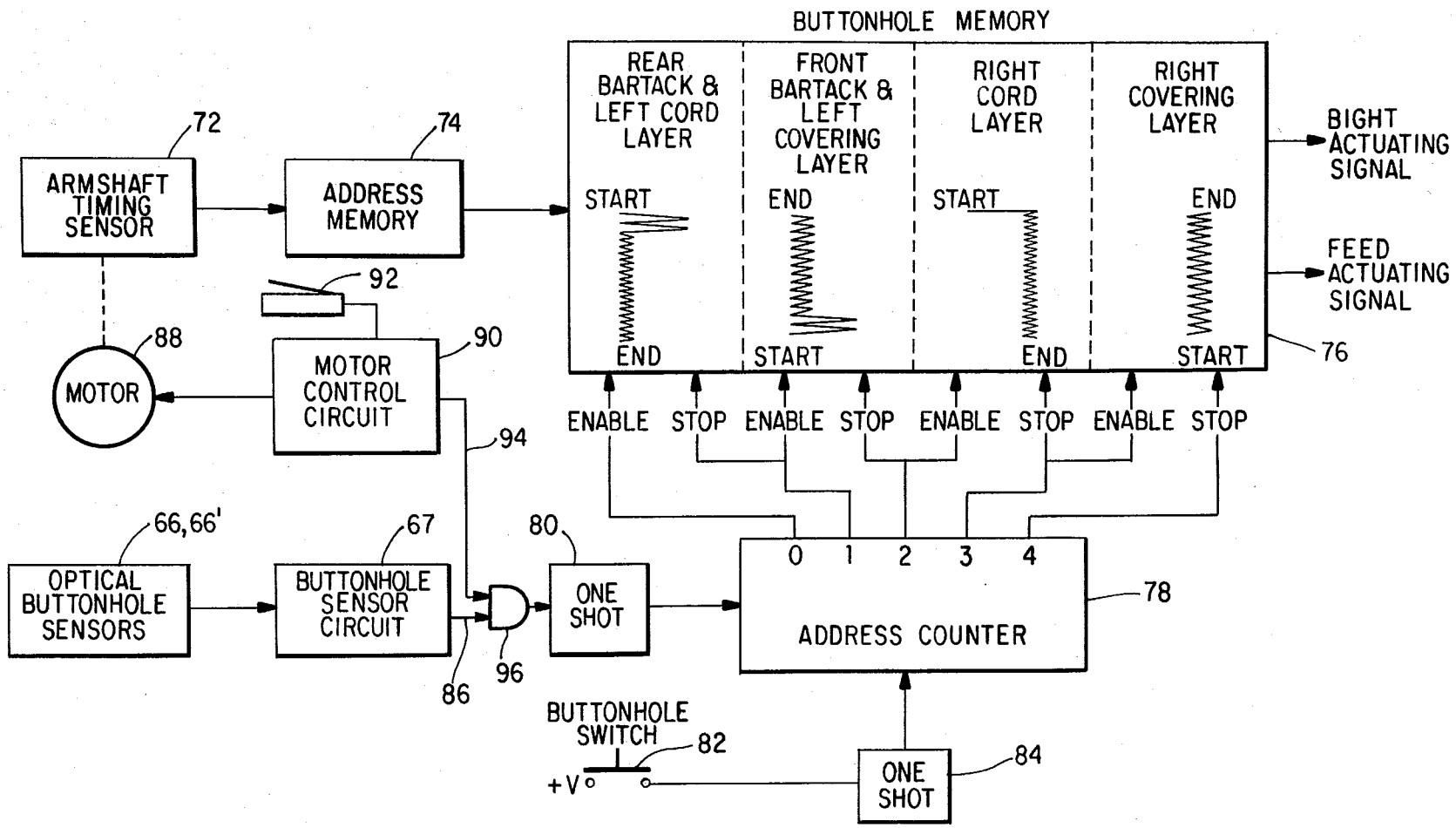
FIG. 2 shows a general block diagram of an illustrative electronic control system for use in a sewing machine to effect the formation of a buttonhole stitch pattern and which incorporates an arrangement according to this invention.

Referring now to FIG. 2, which is comparable to FIG. 4 of the referenced patent and wherein like elements contain the same reference characters as those of the referenced patent, the photosensors 66 and 66' are coupled to a sensor circuit 67 which provides an output on the lead 86 when the photosensors 66 and 66' have different amounts of light reflected thereto such as when one of the sensors is viewing the highly reflective portion 60 and the other of the sensors is viewing the portion 62 which has a low coefficient of reflectivity. An output signal may also be applied to the lead 86 due to false triggering caused by the operator inadvertently moving a hand, fabric, scissors or the like within the field of view of the photosensors 66 and 66'. This is often the case after the operator has sewn a portion of a buttonhole pattern and stops the machine to check the stitch quality. As disclosed in the referenced patent, the sewing machine control circuitry sequences through a plurality of states (illustratively four) in the formation of a buttonhole pattern. Signals from the sensor circuit 67 cause the sequencing to occur. Therefore, if there is a false triggering of the sensor circuit 67, the control circuitry will be improperly sequenced.

In order to cure this inadequacy, which occurs primarily when the sewing machine is stopped, the present invention contemplates utilizing the buttonhole trigger signals only when the sewing machine is running. As is well known in the art, a sewing machine typically includes a motor 88 controlled by a motor control circuit 90 which receives signals from an operator controller, such as a foot pedal, 92. The motor 88 is connected to the main operating shafts of the sewing machine, one of which has mounted thereon the armshaft timing sensor 72 which is utilized by the electronic control system for synchronizing the operation of the actuators which control the stitch forming instrumentalities, as is well known in the art.

In accordance with the principles of this invention, the motor control circuit 90 provides a signal on the lead 94 whenever the motor 88 is caused to run. This may be accomplished in any manner known in the art. An AND gate 96 is illustratively provided having as its inputs the lines 86 and 94. Thus, the only time that a buttonhole trigger signal is transmitted to cause the electronic control circuitry to sequence from one of its buttonhole formation states to the next, is when the drive motor 88 is running. Accordingly, false triggering due to an operator inadvertently moving something within the field of view of the photosensors 66 and 66' is substantially eliminated.

The foregoing description has given a specific example with respect to an electronic control system made up of discrete hardward elements. In recent years, sewing machines have been designed in which programmed microcomputers operate as the control system. It is contemplated that the present invention may also be utilized in such a sewing machine wherein the microcomputer software contains instructions for ignoring any buttonhole trigger signals except when the drive motor is operating, these instructions following the inventive method described herein.

Accordingly, there has been disclosed an arrangement and a method for preventing false triggering in an optically switched buttonhole mechanism. It is understood that the above-described embodiment is merely illustrative of the application of the principles of this invention. Numerous other embodiments may be devised by those skilled in the art without departing from the spirit and scope of this invention, as defined by the appended claims. For example, instead of providing the AND gate 96, the sensor circuit 67 may be enabled only while the motor is running so that trigger signals cannot occur when the motor is stopped.

I claim:

1. In an electronically controlled sewing machine having a controller, a controllable drive motor, and an optical buttonhole mechanism including photosensitive means responsive to changes in the amount of light impinging thereon for providing buttonhole signals adapted to be used by said controller for sequencing through states in the formation of a buttonhole pattern, the improvement comprising:

means enabled only during operation of said drive motor for transmitting said buttonhole signals to said controller.

2. In an electronically controlled sewing machine having a controller, a controllable drive motor, and an optical buttonhole mechanism including photosensitive means responsive to changes in the amount of light impinging thereon for providing buttonhole signals adapted to be used by said controller for sequencing through states in the formation of a buttonhole pattern, a method for substantially eliminating improper sequencing through said buttonhole states due to inadvertent movement of items in the field of view of said photosensitive means comprising the steps of:

determining the operating condition of said drive motor; and utilizing said buttonhole signals only when said drive motor is operating.

* * * * *